US006360788B1

(12) United States Patent
Saurin et al.

(10) Patent No.: US 6,360,788 B1
(45) Date of Patent: Mar. 26, 2002

(54) HOOD FOR THE PROTECTION OF PREMISES

(75) Inventors: Claudio Saurin, Rubano; Benetti Dario, Zimella, both of (IT)

(73) Assignee: Gruppo Bertolaso S.p.A., Zimella (IT)

( * ) Notice: Subject to any disclaimer, the term of this patent is extended or adjusted under 35 U.S.C. 154(b) by 0 days.

(21) Appl. No.: 09/685,347

(22) Filed: Oct. 10, 2000

(30) Foreign Application Priority Data

Oct. 13, 1999 (IT) ..... MI99A2132

(51) Int. Cl.[7] ..... B65B 1/04; B65B 3/04; B67C 3/02

(52) U.S. Cl. ..... 141/93; 141/85; 141/89; 53/425

(58) Field of Search ..... 141/85, 93, 90, 141/91, 92, 89; 222/603, 630; 53/425

(56) References Cited

U.S. PATENT DOCUMENTS 4,992,247 A * 2/1991 Foti ..... 422/304
5,114,670 A * 5/1992 Duffey ..... 422/24
6,098,676 A * 8/2000 Poynter et al. ..... 141/93

* cited by examiner

*Primary Examiner*—Timothy L. Maust
(74) *Attorney, Agent, or Firm*—Hedman & Costigan, P.C.

(57) ABSTRACT

A hood (11) for the protection of premises, in particular for premises where general foodstuffs are treated in a controlled atmosphere, comprising an outer enclosure (18) forming a first chamber (22) to house a machine (12), for instance an oenological rinsing, filling or capping machine (12). The enclosure (18) holds an aspirating element (20) equipped with an opening (42) for discharging air and/or steam to the outside of the hood (11), which delimits the upper part of the first chamber (22) and forms, between its outer surface and the enclosure (18), a second chamber (24) communicating with the first chamber (22). Some fans (28) charge the second chamber (24) with air, which passes from the second chamber (24) to the first chamber (22), spreads out by flowing over the elements of the machine and is then discharged through the opening (42).

12 Claims, 3 Drawing Sheets

HOOD FOR THE PROTECTION OF PREMISES

Figure 1:
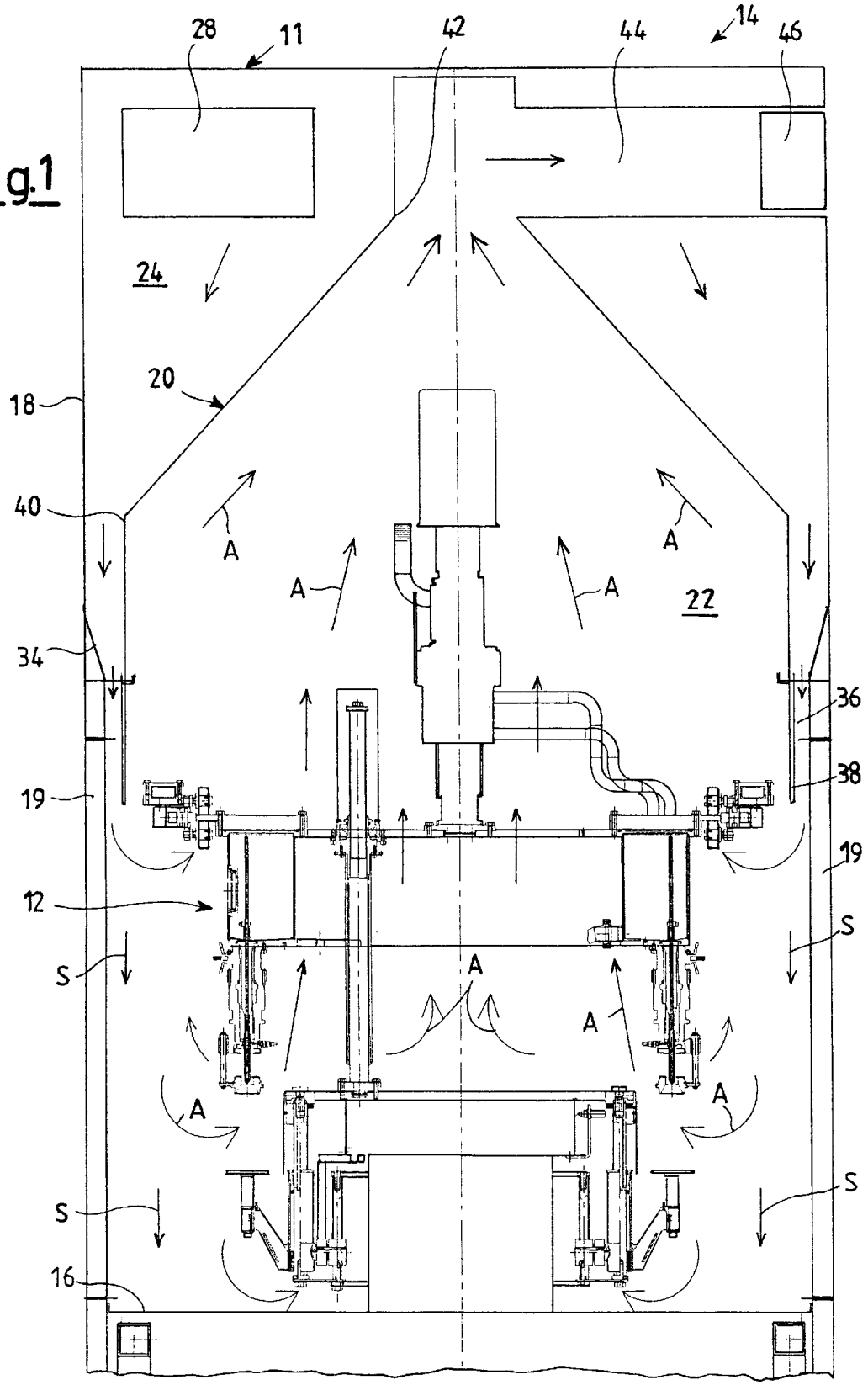

This invention refers to an hood for the protection of premises.

There is at this time, in particular in the oenological or general liquid product bottling trade, or at any rate in all processes exposing a product to outside air, a particularly felt need to operate in premises to be protected as far as possible from potential contaminants originating from the processing premises themselves, while at the same time maintaining a possibility to steam out and sterilize the processing machines (rinsing, filling and capping machines) with appropriate chemicals, so as to ensure a high quality and long lifetime for the bottled product.

The oenological machines are generally installed in premises equipped with laminar flow covers fitted with filters; covers of this type are constituted of an enclosure encompassing the machine and fitted with one or more openings to admit air, one or more openings to expel air and at least one door admitting to the interior of the enclosure, designed to allow ordinary maintenance operations or at any rate to manually operate its regulating elements or devices.

Moreover, a laminar flow of air, at least through openings facing outward and parallel to the vertical walls, is usually injected so as to achieve a reasonable degree of cleanliness in the premises housing the machine, even where said premise have to communicate with the outer environment to allow the passing of operators (sterile combination chambers).

However, the use of such covers fails to achieve a high degree of air purity and the parts not directly invested by the laminar flow may suffer from an increased contamination; this consequently leads to considerable drawbacks in premises housing machines designed for the processing of foodstuffs, due to the fact that the latter exhibit undercuts, moving parts, horizontal surfaces or points difficult to reach.

Moreover, the steam released during the sterilizing phase of parts of the machine or containers tends to foul and plug the clean air filters at the inlet.

Another drawback is determined by the condensed liquid forming on the filters, due to the precipitation of steam or chemicals to be purged, which are pushed up by their lesser density (in case of steam); the condensation liquid deposited in the filters causes the machine to drip, thus leading to even greater damages than in the absence of covers, especially as said liquid constitutes a major carrier of bacteria and eventually of accumulating dust.

In other designs, the covers may be substituted by actual "white" or sterile chambers, capable of providing a specific control of the degree of purity of the air contained in them.

In order to achieve a high degree of purity in the premises under control, the sterile chambers are usually connected to ante-chambers capable of effecting a pretreatment of the incoming air; a subsequent treatment, generally performed by complex and expensive equipment and over rather extensive periods of time allows achieving an extremely high degree of air purity inside the premises to be controlled.

However, whenever the presence of an operator is needed inside a sterile chamber, for example for the performing of maintenance, for regulating or parts replacing on a machine, said operator must wear certain clothes (coverall, face mask and gloves) which could hinder him in performing certain operations.

Finally and as mentioned, the setting up of protected premises for installing food processing machines requires that proper consideration be given to the high installation and operating costs of a sterile chamber, so as to make it possible to thoroughly evaluate the advantages and disadvantages of the various solutions adopted.

The scope of this invention is therefore to eliminate the mentioned technical drawbacks, by producing a hood for the protection of premises, capable of achieving a considerable degree of purity in their interior, at rather limited costs based on the resulting advantages.

Another purpose of this invention is to achieve a hood for the protection of premises, in particular for premises designed to hold machines for treating foodstuffs in a controlled atmosphere.

A further purpose of the invention is to produce a protective hood for premises, in particular for premises designed for the installation of oenological machines such as rinsing, filling and capping machines, capable of allowing any operations, throughout the processing phases exposing foodstuffs to air, to be performed in an ambiance essentially protected from any contaminants originating from the same operating premises, and at the same time of maintaining the possibility of sterilizing and steaming one or more parts of the machine itself.

Still another purpose of the invention is to produce a hood for the protection of premises capable of allowing the protections to be opened so as to perform certain maintenance, sterilizing and/or steaming operations.

Not the least purpose of the invention is to produce a hood for the protection of premises of a safe and reliable kind and in an essentially simple and inexpensive manner with respect to the known art, based on the resulting advantages.

These and other purposes, according to this invention, are achieved by producing a hood for the protection of premises according to claim 1, which is being referred to for brevity.

Other characteristics of the invention are described in subsequent claims.

In an advantageous manner, this means in practice producing a chamber with a controlled and/or sterile atmosphere based on a forced air flow, constituted by the superposition of two hoods set up one inside the other, so as to be compatible with the requirements of achieving a high degree of air purity in the premises even if it becomes necessary to inject steam or a sanitizing liquid on parts or portions of machines installed in said premise, requirements which are normally conflicting.

In particular, this achieves the further advantage, whenever it is desirable to perform some container filling operations by oenological filling machines in a controlled atmosphere based on sanitized air, of eliminating the special protections normally employed while passing the bottles through the machines of a known type.

Figure 2:
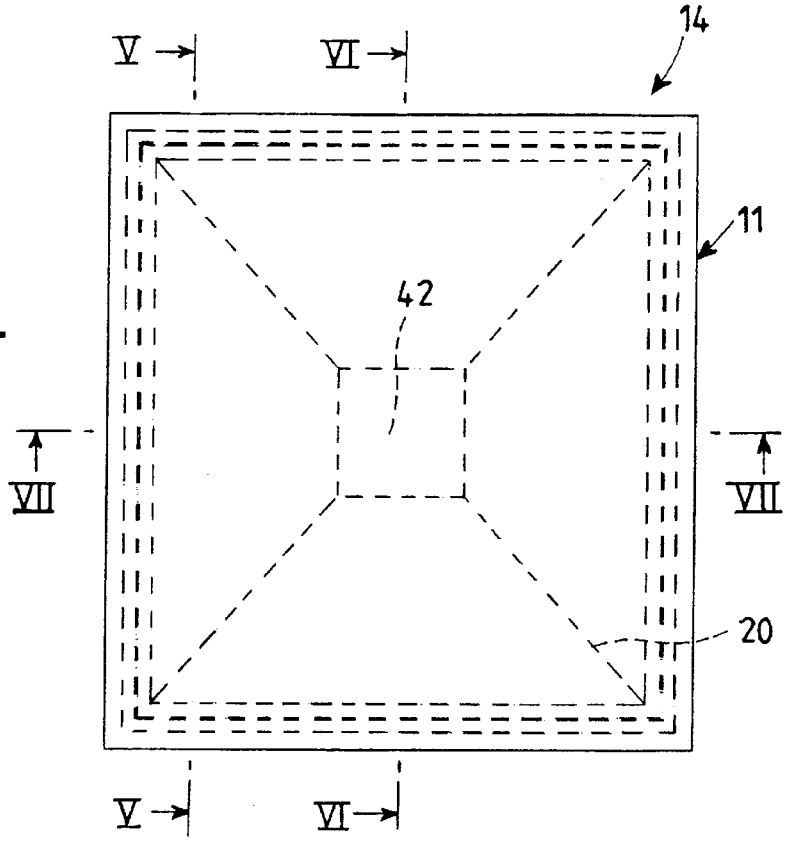
Figure 3:
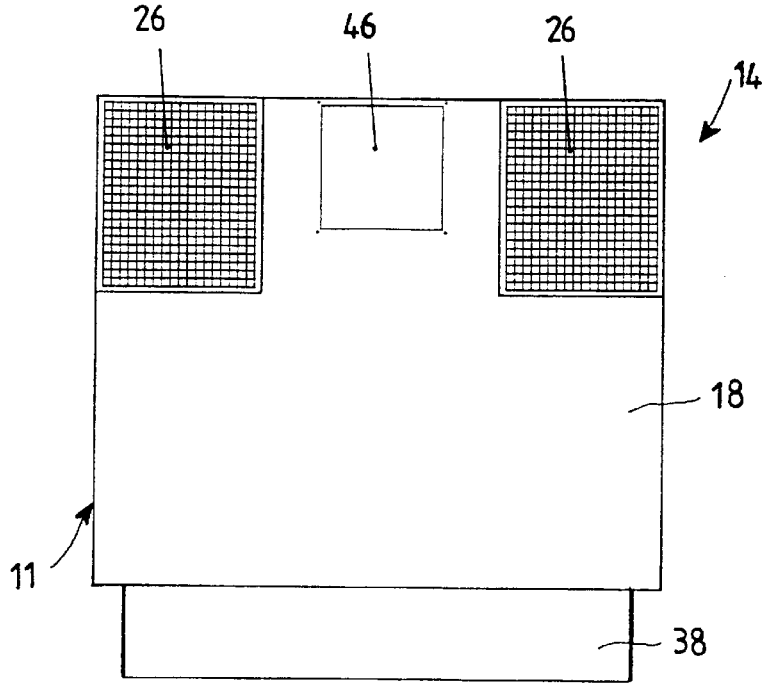
Figure 6:
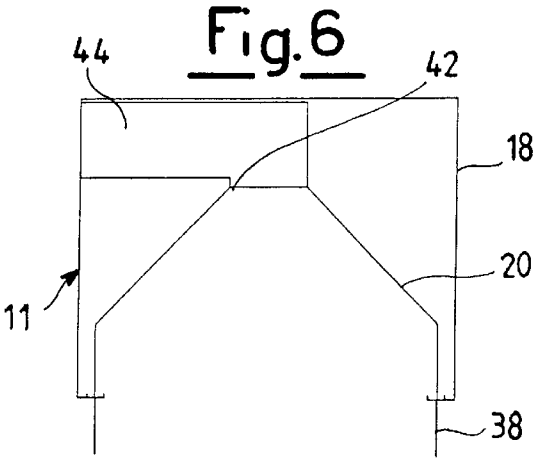
Figure 7:
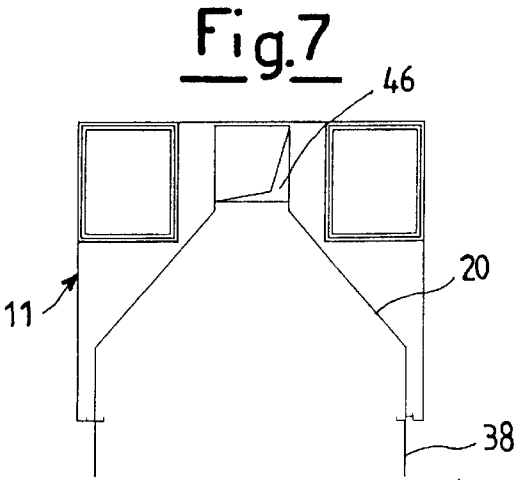
Figure 4:
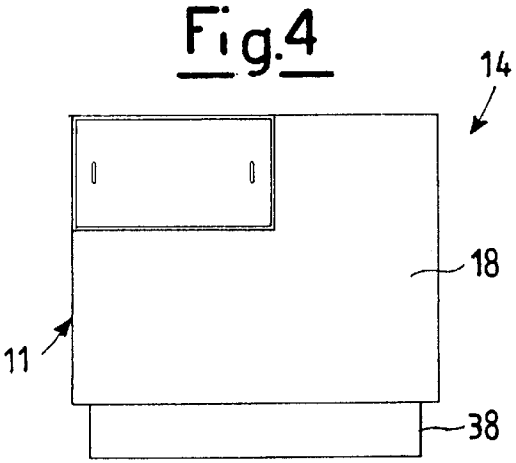
Figure 5:
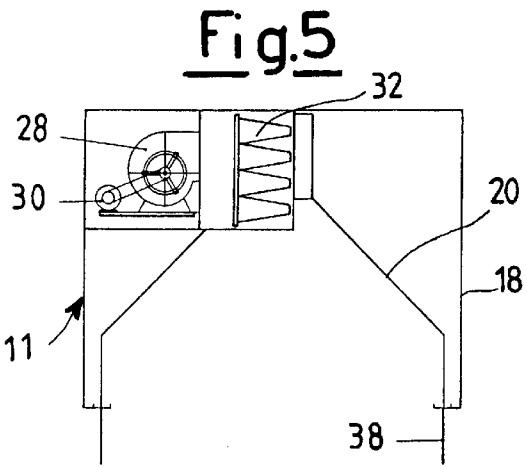

Further characteristics and advantages of a hood for the protection of premises, according to this invention, will be more clearly evident from the following description, offered for exemplifying and limiting purposes and with reference to the schematic enclosed drawings, in which:

FIG. 1 shows front elevation view of a hood for the protection of premises according to this invention, containing an oenological machine, in particular a machine for the filling of foodstuff materials or products into containers such as bottles, FIG. 2 shows a top plan view of a hood for the protection of premises according to this invention, FIG. 3 shows a front elevation view of a portion of the protective hood shown in the FIGS. 1 and 2, FIG. 4 shows a side elevation view of a portion of the hood for the protection of premises shown in the FIGS. 1 and 2, FIG. 5 is a cross-sectional view of a portion of a hood for the protection of premises according to this invention, taken along the line V—V of FIG. 2, FIG. 6 shows a a cross-sectional view of a portion of the hood for the protection of premises according to this invention, taken along the line VI—VI of FIG. 2, FIG. 7 shows a cross-sectional view of a portion of the hood for the protection of premises according to this invention, taken along the lines VII—VII of FIG. 2.

With reference to the mentioned figures, 14 indicates a group comprising a hood 11 for the protection of premises, a cover for an oenological machine 12, in particular of a machine for the filling of foodstuffs (water, wine, fruit juice) into containers such as bottles.

At this point, it is to be emphasized once and for all that the protective hood 11 may be provided as a cover for any machinery for the processing of foodstuffs during the processing phases when the product is exposed to outside air; in oenological plants, in particular, such hoods 11 may be provided to cover any filling, rinsing or capping machines.

The machine 12 is supported by a base 16, while the hood comprises a sealed enclosure 18 generally made of stainless steel, fitted with openings or doors 19 and holding an aspirating element 20 in its interior. The machine 12 is in turn housed in a chamber 22 inside the enclosure 18 and delimited in its upper part by the inner surface of the aspirating element 20. The air is admitted to the hood 11 through a second chamber 24, also set inside the enclosure 18 but delimited by the outer surface of the aspirating element 20.

More in detail, the enclosure 18 exhibits a rectangular or polygonal plan view and is provided with two openings fitted with grids 26, set opposite two of its frontal top edges. Each of these grids 26 is connected to the aspiration of a fan 28 actuated by a motor 30, which forces the air to cross one or more filters 32 before feeding it into the chamber 24.

The chamber 24 communicates with the chamber 22 through a perforated partition 34 shaped in the form of a ring with a rectangular plan view and capable, through a cavity 36, of conveying the flow of air originating from the chamber 24 to the chamber 22. The cavity 36 is delimited by a peripheral wall of the enclosure 18 and an annular element 38 with a rectangular or polygonal plan view, set inside the chamber 20 and constituted by various partitions or deflectors, each of which is parallel to one of the peripheral walls of the enclosure 18.

The aspirating element 20 is profiled in the shape of a truncated pyramid, with a lower prismatic portion 40 connected to the annular portion 38, and an upper portion fitted with an opening 42 at the top. This opening 42 is connected with a duct 44 running across the hood 11 and opening up onto the front wall of the enclosure 18. In certain preferred and exemplifying but non-limiting embodiments of this invention, the extremity of the duct 44 carries a true aspirator 46, which may or not be equipped with filtering devices.

The operation of a hood for the protection of premises according to this invention is essentially as follows.

In an operating phase, the air is aspirated from the premises wherein the machine 12 is installed, and passed through the filters 32, capable of a greater or lesser filtering action (depending on the customer's requirements); the fans 28 then take care of injecting it into the chamber 24 and thence into the chamber 22, by channeling it through the partitions 34 positioned along the perimeter of the machine 12 and appropriately perforated so as to direct a forced flow of air in an essentially vertical and downward sense, as clearly indicated by the arrows S in FIG. 1, so as to form a barrier against any particles suspended in the air coming from outside the machine 12.

The air is thus present inside the chamber 18 and flows over all the parts of the machine 12, while circulating in a forced manner in the sense and direction of the arrows shown by A in FIG. 1.

The air filtered through the center of the machine 12, at the chamber 22, is then aspirated by the aspirator 46 through the duct 44, so as to keep the relevant surfaces of the machine 12 in contact with the just introduced air; in this connection, it should be noted that an aspiration through a lateral duct, such as that afforded by a hood according to the invention, also allows avoiding a construction of hoods of excessive height and permanently eliminates the downward dripping problem due to condensed liquid formed during the steaming out or sanitizing phase of certain parts or components of the machine 12.

The flow rate of filtered air is always kept at a level in excess of that of the central aspirator 46, so as to constantly maintain the machine 12 under a slight overpressure and to prevent the entrance of any contaminants from the outside.

Whenever the door 19 is opened as needed to permit any manual operation on the machine 12, such as for regulating or replacing the containers, filling or transferring the foodstuffs, the central aspirator 46 must be shut down and the flow of incoming filtered air to the hood 11 increased so as to maintain a balance in the degree of air purity achieved between the inside of the hood 11 and the surfaces of the machine 12. The forced air flow leaving the openings 34 prevent the entrance of air from the outside.

When sanitizing any parts or components of the machine 12 while insufflating steam or treating it with other chemical compounds, the operation of the hood 11 is similar to that described above during the operating phase, with the sole difference that the aspirating and air inflowing speed must in this case be maintained at a higher level, as it is additionally necessary to consider the flow rate and density of the steam or chemical agent introduced; during the steaming out or sanitizing phase it is in any case necessary to maintain a slight overpressure inside the machine 12 at all times.

The above description clearly outlines the characteristics as well as the advantages of a hood for the protection of premises according to this invention.

In particular, it has been possible to verify that a hood according to the invention is particularly advantageous, as it manages to combine a high degree of reliability and efficiency in a single product, as regards the degree of purity achieved in the premises, with that of extreme practicality and economy, as regards the advantages available with respect to those of the known art.

It is finally clear that the hood for the protection of premises according to this invention may be susceptible to numerous modifications and variants all falling within the scope of the inventive idea, just as it is clear that the details, the dimensions and the materials used may be of any kind depending on the technical requirements, and may also be substituted by others of a technically equivalent type.

What is claimed is:

1. A hood (11) for the protection of premises where foodstuffs are treated in a controlled atmosphere, said hood comprising an enclosure (18) for housing a machine (12) to perform said treatments, said enclosure having a first chamber (24) providing at least one fan (28) capable of aspirating air from the outside and injecting it inside the premises, said enclosure (18) containing at least one element (20) for aspirating the air present in said hood (11), and a second chamber (22), communicating with said first chamber (24), said second chamber (22) being placed between an outer surface of said first chamber (24) and said enclosure (18).

2. A hood (11) according to claim 1, characterized in that said first chamber (24) communicates with said second chamber (22) through at least one perforated partition (34).

3. A hood (11) according to claim 2, characterized in that said partition (34) is profiled as a ring and capable of conveying a forced air flow (S) originating from said first chamber (24) to said second chamber (22), across at least one cavity (36).

4. A hood (11) according to claim 3, characterized in that said cavity (36) is comprised between a peripheral wall of said enclosure (18) and a polygonal element (38) firmly attached to said aspirating element (20).

5. A hood (11) according to claim 1, characterized in that said aspirating element (20) has an upper portion fitted with at least one opening (42).

6. A hood (11) according to claim 5, characterized in that said opening (42) is connected to the duct (44) of an aspirator (46).

7. A hood (11) according to claim 1, characterized in that said aspirator (28) is connected to at least one filtering element (32).

8. A hood (11) according to claim 1, characterized in that said machine (12) comprises a machine for bottling plants, where said machine (12) or parts thereof are sterilizable by steam or other chemical sanitizing agents.

9. A hood (11) according to claim 1, characterized in that said air is conveyed toward the center of said machine (12), so as to maintain a forced air flow (A) inside said second chamber (22).

10. A hood (11) according to claim 1, characterized in that the air flows of said air injected by said fan (28) into the premises are greater than the air flows aspirated by said aspirating element (20), so as to maintain said machine (12) at a slight overpressure.

11. A hood (11) according to claim 1, characterized in that the operation of said aspirating element (20) is interrupted, while the air flow of said fan (28) increases, whenever at least one opening (19) is provided at said outer enclosure (18) to access said machine (12) and manually perform any operations on parts or components of the same.

12. A hood (11) according to claim 1, characterized in that said machine (12) is a filling, rinsing or capping machine.

* * * * *